US012448238B2

(12) United States Patent
Adachi et al.

(10) Patent No.: US 12,448,238 B2
(45) Date of Patent: Oct. 21, 2025

(54) SHEET FEEDING DEVICE

(71) Applicant: CANON KABUSHIKI KAISHA, Tokyo (JP)

(72) Inventors: Seiichiro Adachi, Chiba (JP); Toshiyuki Ichikawa, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 35 days.

(21) Appl. No.: 18/636,686

(22) Filed: Apr. 16, 2024

(65) Prior Publication Data

US 2024/0391716 A1 Nov. 28, 2024

(30) Foreign Application Priority Data

May 25, 2023 (JP) ..... 2023-086522
Aug. 10, 2023 (JP) ..... 2023-131593

(51) Int. Cl.
*B65H 3/12* (2006.01)
*B65H 3/48* (2006.01)

(52) U.S. Cl.
CPC ..... *B65H 3/128* (2013.01); *B65H 3/48* (2013.01); *B65H 2405/15* (2013.01); *B65H 2406/31* (2013.01); *B65H 2406/323* (2013.01); *B65H 2406/351* (2013.01); *B65H 2406/3662* (2013.01); *B65H 2515/10* (2013.01); *B65H 2515/805* (2013.01); *B65H 2801/06* (2013.01)

(58) Field of Classification Search
CPC ..... B65H 3/128; B65H 3/48; B65H 2406/31; B65H 2406/323
See application file for complete search history.

(56) References Cited

U.S. PATENT DOCUMENTS 4,451,028 A * 5/1984 Holmes ..... B65H 3/128 271/93
5,478,066 A 12/1995 Yoshida
8,953,230 B2 2/2015 Adachi
10,183,824 B2 1/2019 Adachi

FOREIGN PATENT DOCUMENTS

JP H06-199437 A 7/1994
JP 2017-132556 A 8/2017

* cited by examiner

*Primary Examiner* — Jeremy R Severson
(74) *Attorney, Agent, or Firm* — Venable LLP

(57) ABSTRACT

A sheet feeding device includes a supporting portion supporting sheets, an air blower blowing an air toward an upstream end from a downstream end of the sheets supported by the sheet supporting portion in a sheet feeding direction, a belt feeding and sucking the uppermost sheet of the sheets to which the air is blown by the air blower, and an upstream suction portion disposed upstream of the feeding belt in the sheet feeding direction and sucking the uppermost sheet. The belt includes a first suction area opposing the uppermost sheet and sucking the uppermost sheet. The upstream suction portion includes a second suction area opposing the uppermost sheet and sucking the uppermost sheet. In a widthwise direction perpendicular to the sheet feeding direction, a width of the second suction area is narrower than a width of the first suction area.

14 Claims, 11 Drawing Sheets

SHEET FEEDING DEVICE

FIELD OF THE INVENTION AND RELATED ART

The present invention relates to a sheet feeding device for feeding a sheet.

In Japanese Patent Application Laid-Open No. H06-199437, an air sheet feeding device provided with a sheet tray, a blower which floats a sheet stacked on the sheet tray by air, and a sheet conveyance portion which suctions and conveys the floated sheet is disclosed. The sheet conveyance portion includes a sheet suction portion, such as a suction fan, and a conveyance belt, which covers the sheet suction portion. The sheet is sucked onto the conveyance belt by suction force of the sheet suction portion. The sheet sucked onto the conveyance belt is fed as the conveyance belt is rotated.

However, in a case of the air sheet feeding device such as those described in Japanese Patent Application Laid-Open No. H06-199437, it is necessary to securely separate an uppermost sheet from a lower sheet thereof, for example, when feeding a long sheet or a sheet having high adhesion between the sheets.

In a state in which the uppermost sheet and the lower sheet are adhered to each other, the air sent from the blower to a leading end of the sheet may not reach a trailing end of the sheet, but may escape in a widthwise direction of the sheet on a way, resulting in occurrence of separation defect of the sheet.

SUMMARY OF THE INVENTION

An object of the present invention is to provide a sheet feeding device capable of suppressing separation defect of the sheet.

According to an aspect of the present invention, there is provided a sheet feeding device comprising: a sheet supporting portion configured to support sheets; an air blowing portion configured to blow an air toward an upstream end from a downstream end of the sheets supported by the sheet supporting portion in a sheet feeding direction; a feeding belt configured to feed and suck the uppermost sheet of the sheets to which the air is blown by the air blowing portion; and an upstream suction portion disposed upstream of the feeding belt in the sheet feeding direction and configured to suck the uppermost sheet, wherein the feeding belt includes a first suction area opposing the uppermost sheet and configured to suck the uppermost sheet, and the upstream suction portion includes a second suction area opposing the uppermost sheet and configured to suck the uppermost sheet, and wherein in a widthwise direction perpendicular to the sheet feeding direction, a width of the second suction area is narrower than a width of the first suction area.

Further features of the present invention will become apparent from the following description of exemplary embodiments with reference to the attached drawings.

Figure 3:
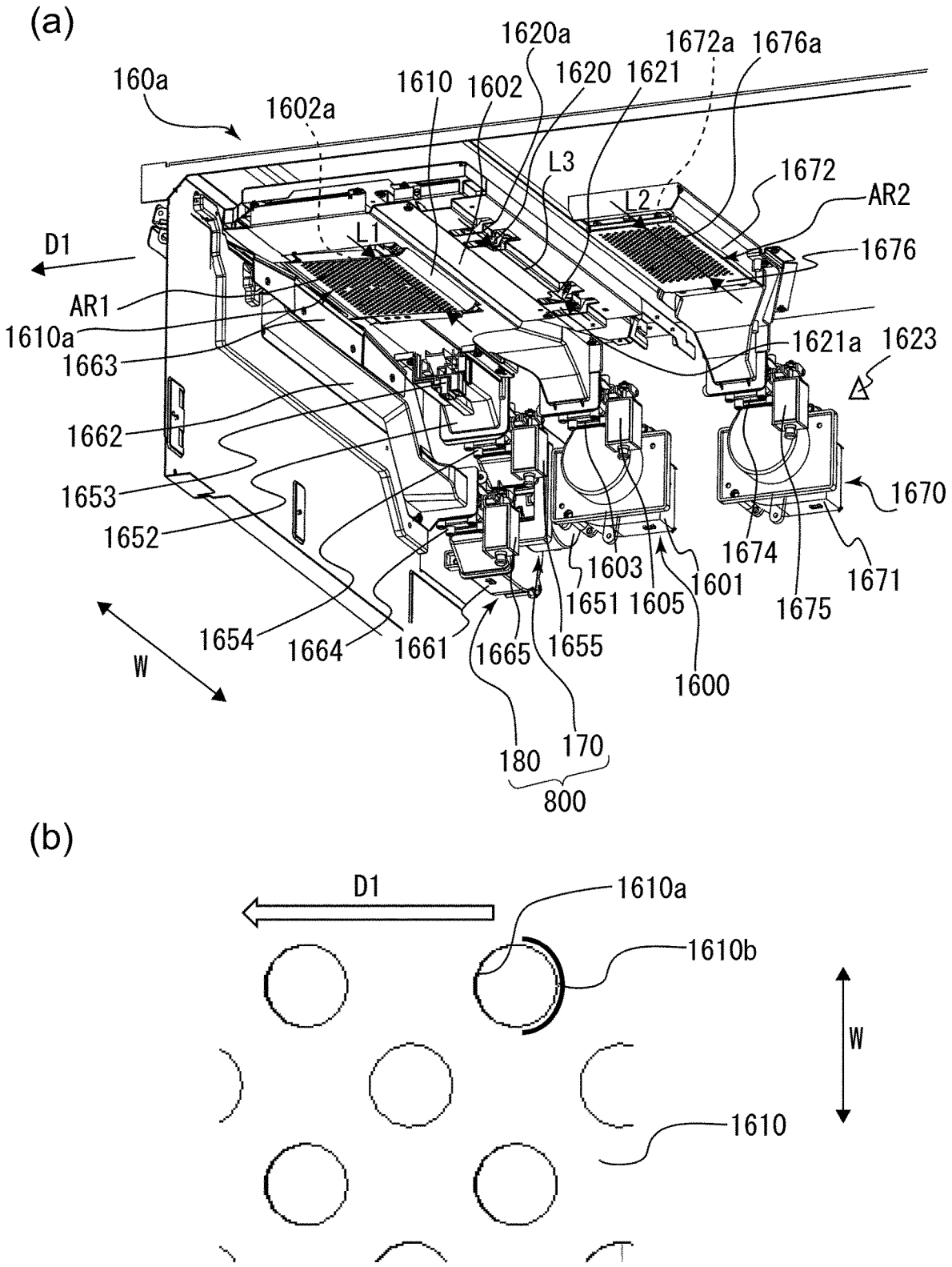

Part (a) of FIG. 3 is a perspective view illustrating a feeding unit, and part (b) of FIG. 3 is an enlarged view illustrating a plurality of holes formed in a separating belt.

Figure 4:
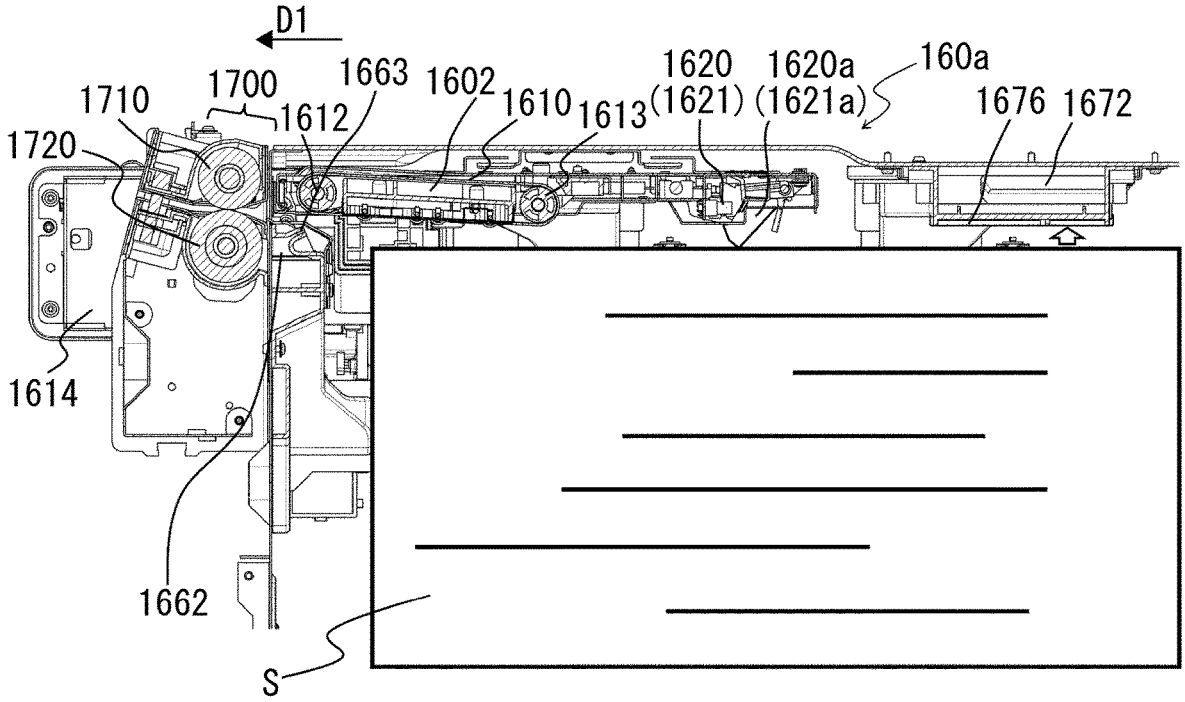

FIG. 4 is a cross-sectional view illustrating the feeding unit.

Figure 5:
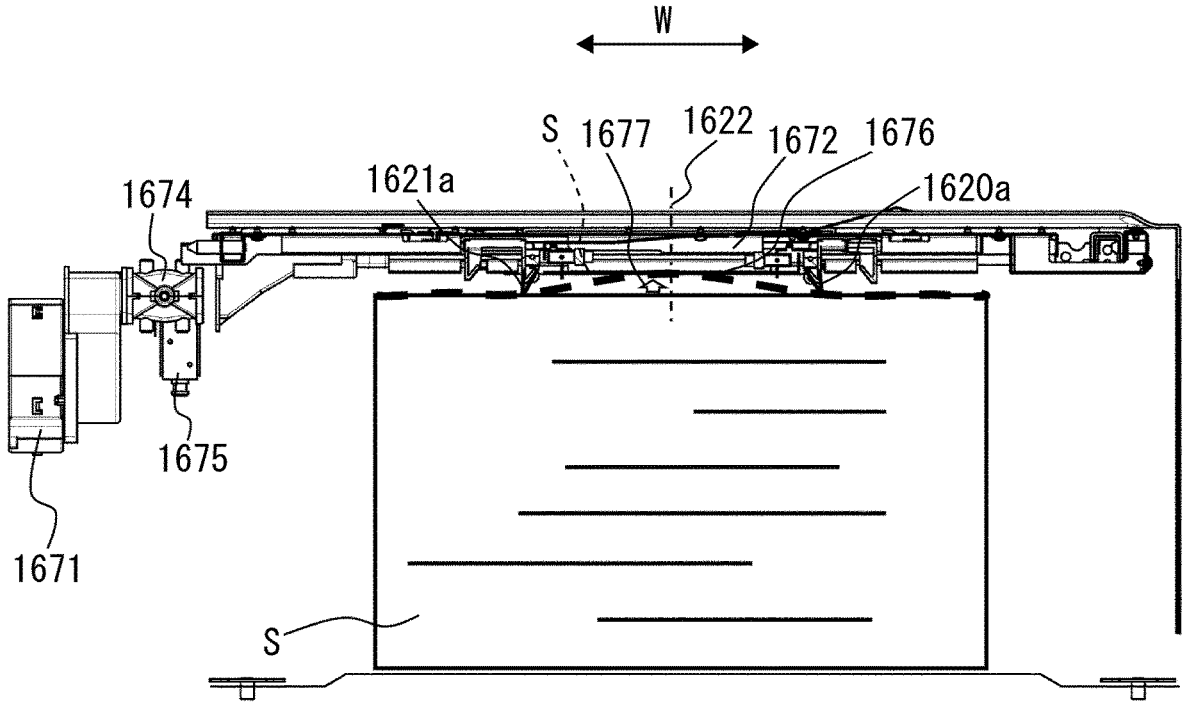

FIG. 5 is a front view illustrating the feeding unit.

Figure 6:
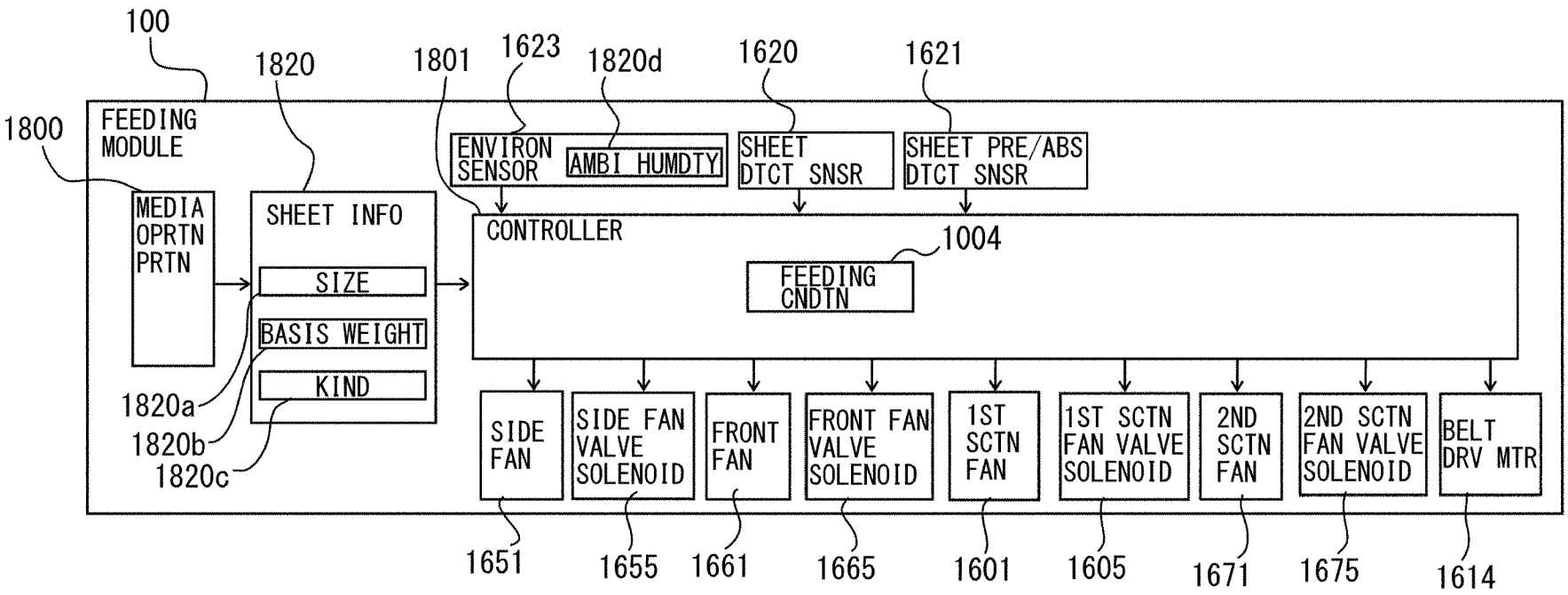

FIG. 6 is a block diagram illustrating control blocks of a feeding module.

Figure 7:
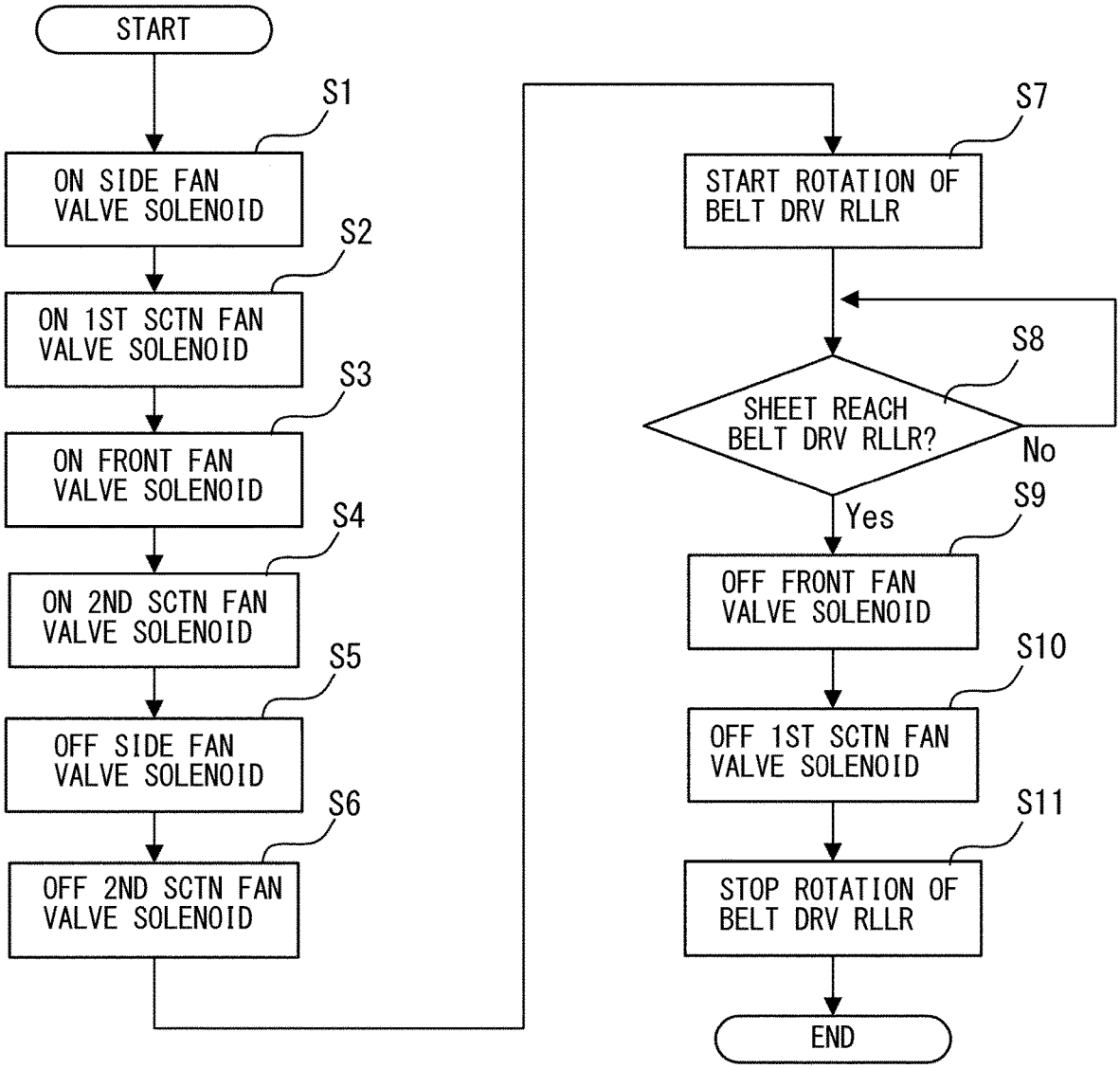

FIG. 7 is a flowchart illustrating feeding operation.

Figure 8:
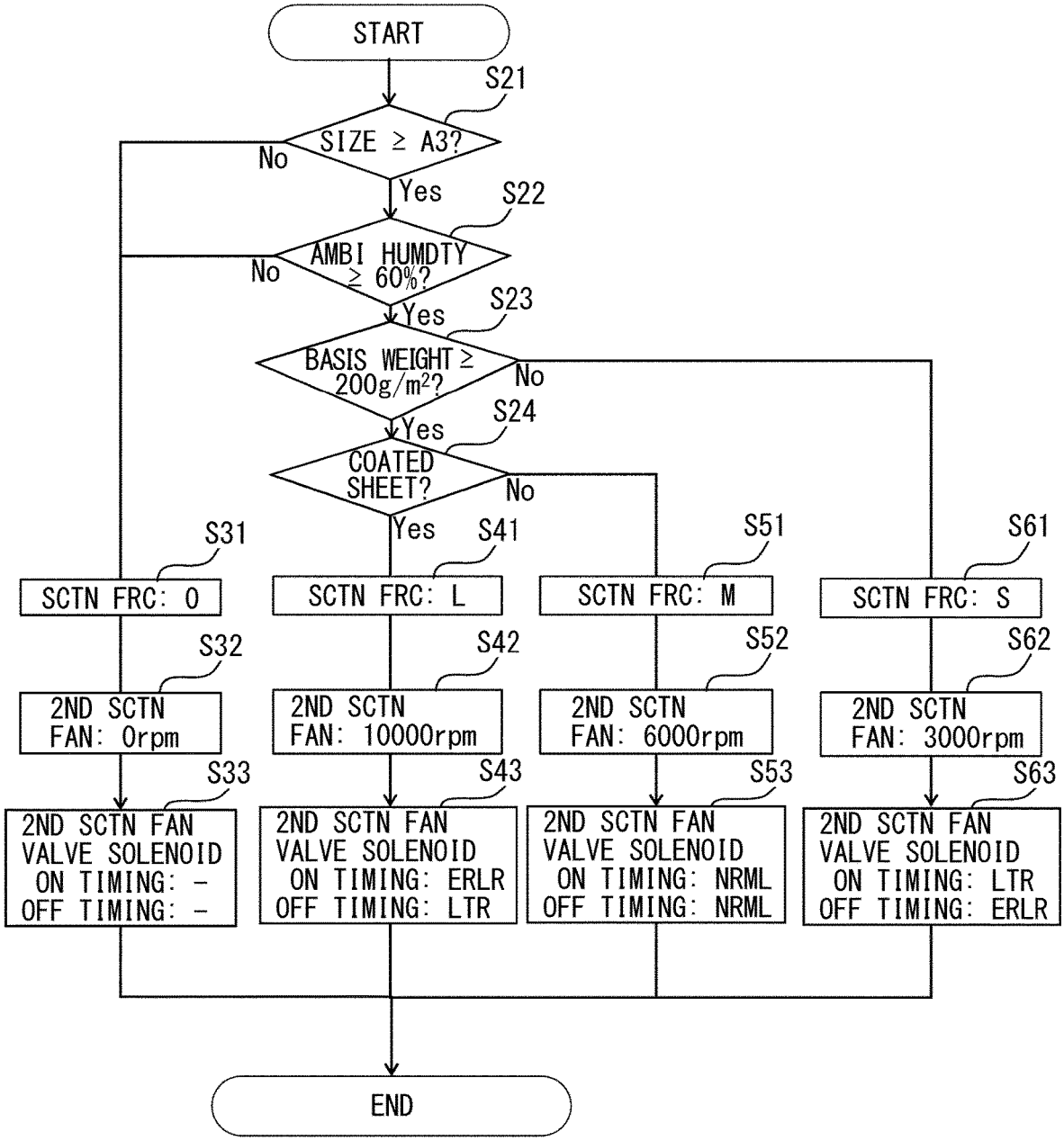

FIG. 8 is a flowchart illustrating control to change suction force and a suction timing of a second suction unit.

Figure 9:
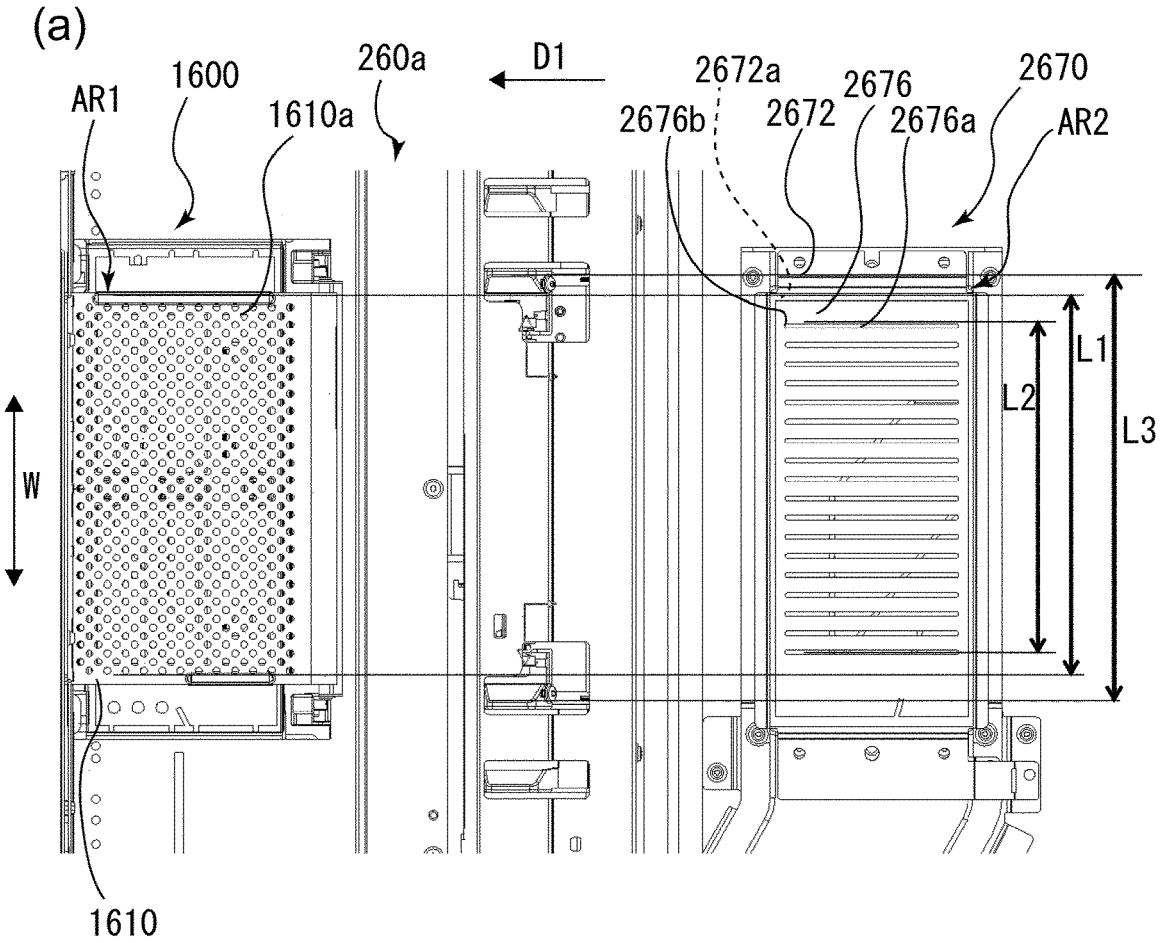
Figure 9:
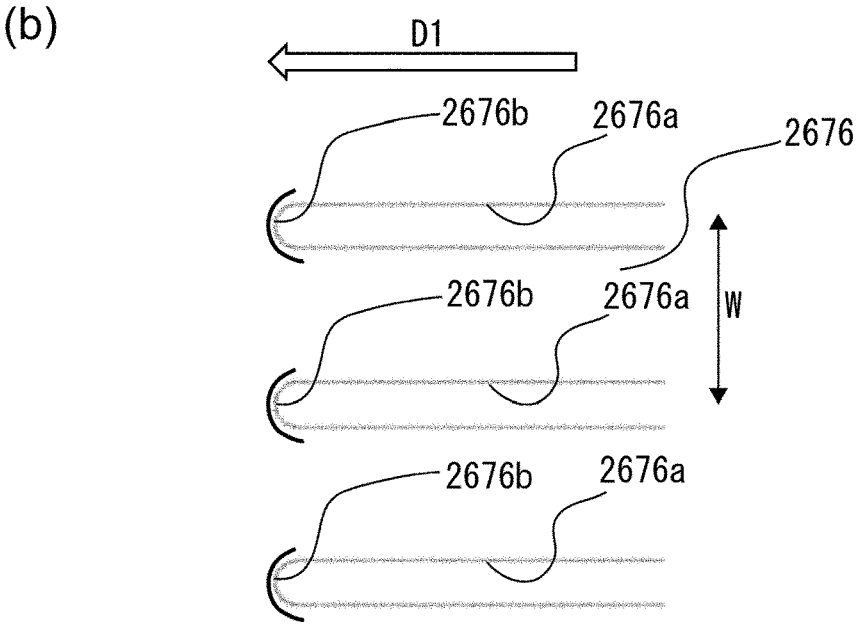

Part (a) of FIG. 9 is a bottom view illustrating a feeding unit according to an Embodiment 2, and part (b) of FIG. 9 is an enlarged view illustrating a plurality of elongated holes provided in a chamber guide.

Figure 10:
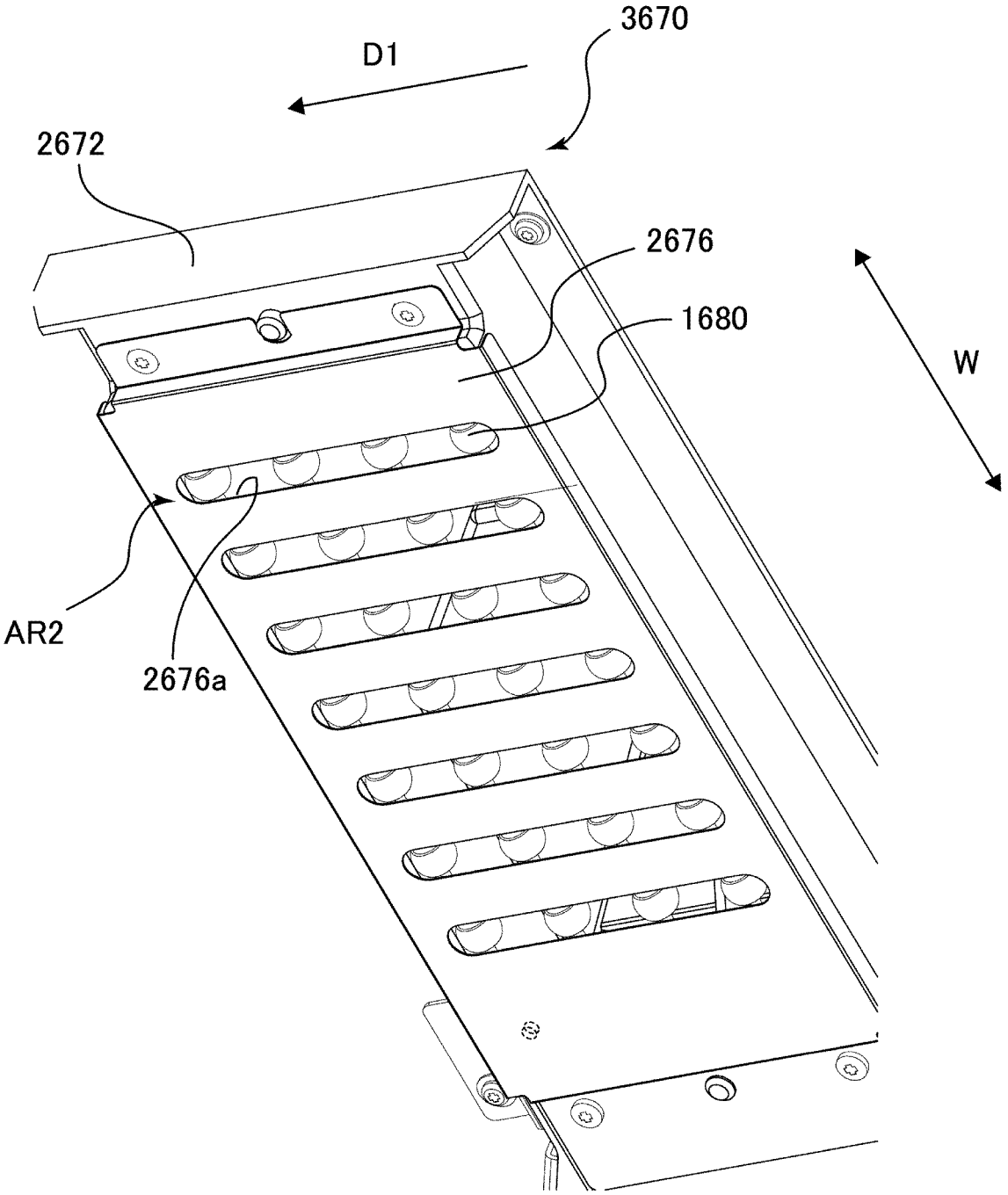

FIG. 10 is a perspective view illustrating a second suction unit according to an Embodiment 3.

Figure 11:
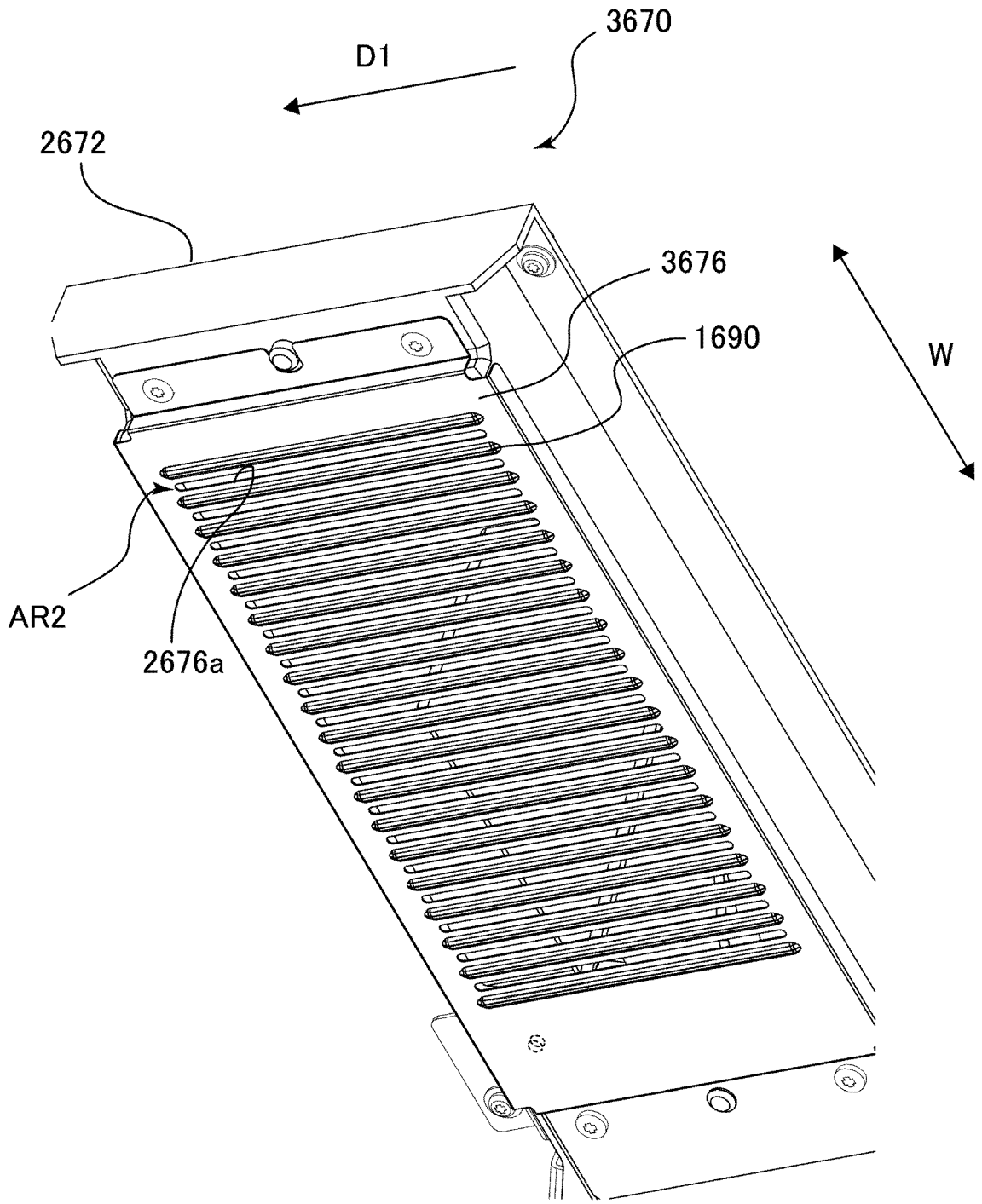

FIG. 11 is a perspective view illustrating a second suction unit according to an Embodiment 4.

DESCRIPTION OF THE EMBODIMENTS

Hereinafter, the present Embodiments will be described using Figures. Incidentally, since the Embodiments which will be described hereinafter are suitable embodiments of the present invention, various technically preferred limitations are given, however, a scope of the present invention is not unduly limited by the following description, and not all of configurations described by the present Embodiments are essential elements of the present invention.

Embodiment 1

[Overall Configuration of an Inkjet Recording System]

Figure 1:
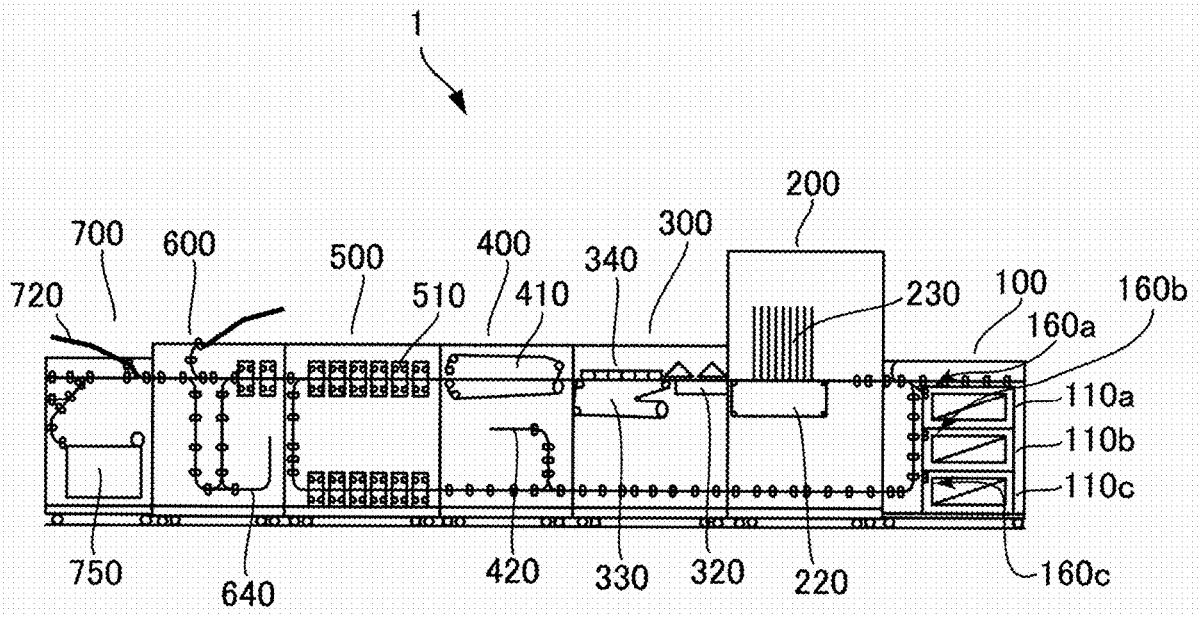
FIG. 1 is an overall schematic view of a printer according to a present Embodiment.

In an Embodiment 1, a case in which an image forming system is applied to an inkjet recording system 1 will be described. FIG. 1 is a schematic view illustrating an example of an outline configuration of an inkjet recording system 1. This inkjet recording system 1 is an inkjet recording system of a sheet-feeding type, which produces a record forming an ink image on a sheet. As shown in FIG. 1, the inkjet recording system 1 is constituted by a feeding module 100, a printing module 200, a drying module 300, a fixing module 400, a cooling module 500, a reversing module 600 and a discharging module 700. The cut paper like sheet fed from the feeding module 100 is conveyed along a conveyance path, processed in each module, and discharged in the discharging module 700. Incidentally, the sheet in the present Embodiment includes a paper such as a sheet and an envelope, a plastic film such as a sheet for an overhead projector (OHP), cloth, etc.

The feeding module 100, which is an example of a sheet feeding device, is provided with three storages 110*a*, 110*b* and 110*c* accommodating the sheets. Each of the storages 110*a*, 110*b* and 110*c* is configured to be drawable toward a front side of the device. The sheets are fed one by one by a feeding unit (160*a*, 160*b* and 160*c*) in each storage 110*a*, 110*b* and 110*c*, and conveyed to the printing module 200. Incidentally, a number of storages 110*a*, 110*b* and 110*c* is not limited to three, but the system may be configured to include one, two, or four or more storages.

The printing module 200 includes a pre image forming registration correcting portion, which is not shown, a printing belt unit 220 and a recording portion 230. The sheet conveyed from the feeding module 100 is conveyed to the printing belt unit 220 after a tilt and a position of the sheet are corrected by the pre image forming registration correcting portion. The recording portion 230 is disposed in a position opposite to the printing belt unit 220 with respect to the conveyance path. The recording portion 230 is a sheet processing portion which forms an image on the sheet by performing a recording process (printing) with a recording head from above with respect to the sheet which is being conveyed. A plurality of recording heads are lined up along a conveyance direction. In the present Embodiment, a total of five recording heads of line type corresponding to four colors of Y (yellow), M (magenta), C (cyan) and Bk (black), as well as reaction fluid are provided. Incidentally, a number of colors and recording heads is not limited to five.

For an inkjet type, a type using a heat generating element, a type using a piezoelectric element, a type using an electrostatic element, a type using MEMS element, etc. can be employed. The ink of each color is supplied from an ink tank, which is not shown, to the recording head via an ink tube, respectively. The sheet printed in the recording portion 230 is suctioned and conveyed by the printing belt unit 220 with ensuring clearance with the recording heads. For the sheet printed in the recording portion 230, misalignment and color density of the image formed on the sheet are detected by an in-line scanner, which is not shown, disposed on a downstream side of the recording portion in the sheet conveyance direction. The detection result is used for correction of the printed image.

The drying module 300 includes a decoupling portion 320, an upper belt unit 330 and a warm air blowing portion 340, and the drying module 300 reduces the liquid content contained in the ink imparted on the sheet in the recording portion 230 of the printing module 200 and enhances fixing performance of the ink to the sheet. The sheets printed in the recording portion 230 of the printing module 200 are conveyed to the decoupling portion 320, which is disposed on an upstream side of the drying module 300 in the sheet conveyance direction. The decoupling portion 320 can convey the sheet with wind pressure from above and friction of a belt, and prevents misalignment of the sheet on the printing belt unit 220, which forms the ink image, by weakly holding and conveying the sheet on the belt. The drying belt unit 330 is disposed below the belt and the warm air blowing portion 340 is disposed above the belt, opposing each other across the belt.

The sheet conveyed from the decoupling portion 320 is suctioned and conveyed by the drying belt unit 330, and at the same time, a surface on which the ink has been supplied is dried by receiving the warm air from the warm air blowing portion 340. Incidentally, with regard to a drying type, in addition to a type imparting the warm air, it may be constituted by combining a type irradiating electromagnetic waves (such as ultraviolet or infrared rays) onto the surface of the sheet and a conduction heat transfer type by a contact of a heat generating element.

The fixing module 400 includes a fixing belt unit 410. The fixing belt unit 410 includes an upper belt unit and a lower belt unit, and fixes the ink to the sheet by passing the sheet conveyed from the drying module 300 through between the heated upper belt unit and the lower belt unit.

The cooling module 500 is provided with a plurality of cooling portions 510, and cools the hot sheet conveyed from the fixing module 400. The cooling portion 510 is configured to cool the sheet by sucking outside air into a cooling box with a fan, increasing pressure in the cooling box, and blowing the air to the sheet from a nozzle formed on a conveyance guide. The cooling portion 510 is disposed on both an upside and a downside with respect to the conveyance path and cools the sheet from both sides.

The cooling module 500 also includes a conveyance path switching portion, which can switch the sheet conveyance path depending on a case in which the sheet is conveyed to the reversing module 600 or a case in which the sheet is conveyed to a double-side conveyance path, which is used upon a double-side printing. During the double-side printing, the sheet is conveyed to a conveyance path in a lower portion of the cooling module 500. In this case, the sheet is further conveyed along the double-side conveyance path from the cooling module 500 through the fixing module 400, the drying module 300, the printing module 200 and the feeding module 100. In the double-side conveyance path of the fixing module 400, a first reversing portion 420 is provided to reverse a front and back of the sheet. The sheet is then conveyed again from the feeding module 100 through the pre image forming registration correcting portion of the printing module 200, the printing belt unit 220 and the recording portion 230, and the sheet is printed in the recording portion 230.

The reversing module 600 includes a second reversing portion 640, and can reverse the front and back of the conveyed sheet and change front and back orientation of the discharged sheet. The discharging module 700 includes a top tray 720 and a stacking portion 750, which aligns and stacks the sheet conveyed from the reversing module 600.

[Feeding Module]

Next, a configuration of the feeding module 100 will be described in detail. The sheets accommodated in the three storages 110*a*, 110*b* and 110*c* described above, which are provided to the feeding module 100, are fed by the feeding units 160*a*, 160*b* and 160*c* corresponding to each storage 110*a*, 110*b* and 110*c*, respectively. Since the storages 110*a*, 110*b* and 110*c* and the feeding units 160*a*, 160*b* and 160*c* have similar configurations, hereinafter, the storage 110*a*, the feeding unit 160*a* and surrounding configuration thereof will be described in detail. Incidentally, the storages 110*a*, 110*b* and 110*c* and the feeding units 160*a*, 160*b* and 160*c* need not have all the same configuration as each other. For example, maximum numbers or sizes of the sheets which can be accommodated in the storages 110*a*, 110*b* and 110*c* may differ from each other.

Figure 2:
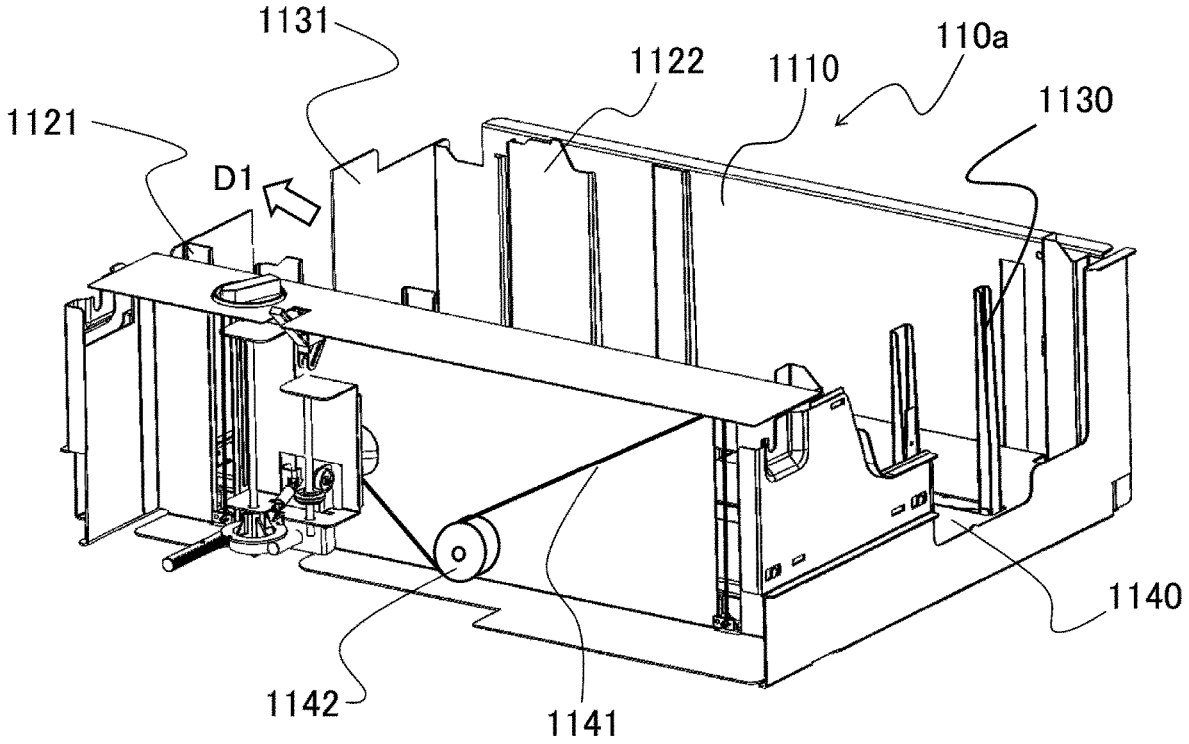
FIG. 2 is a perspective view illustrating a storage.

As shown in FIG. 2, the storage 110*a* includes a main body portion 1110, a lifter plate 1140, a leading end guide 1131, a trailing end guide 1130, a first side guide 1121 and a second side guide 1122, all of which are supported by the main body portion 1110. The lifter plate 1140 as a sheet supporting portion supports the sheets and is suspended by lifter wires 1141. The lifter plate 1140 is configured to be movable in a vertical direction while maintaining a horizontal state of the sheet by the lifter wires 1141 being wound or unwound by wire pulleys 1142 driven by motors, which are not shown.

The leading end guide 1131 regulates a leading end, i.e., a position of a downstream end in a sheet feeding direction D1 of the sheet stacked on the lifter plate 1140. The trailing end guide 1130 regulates a trailing end, i.e., a position of an upstream end in the sheet feeding direction D1 of the sheet stacked on the lifter plate 1140. The first side guide 1121 and the second side guide 1122 are configured to be movable in a widthwise direction W, which is perpendicular to the sheet feeding direction D1, and regulate positions of end portions in the widthwise direction W of the sheet stacked on the lifter plate 1140. Incidentally, the storage 110*a* is configured to be mountable on and dismountable from a housing of the feeding module 100 in the widthwise direction W, and is drawn out to the first side guide 1121 side and mounted on the second side guide 1122 side in the widthwise direction W.

Part (a) of FIG. 3 is a perspective view illustrating the feeding unit 160*a* and the surrounding configuration thereof, and part (b) of FIG. 3 is an enlarged view illustrating a plurality of holes 1610*a* formed in a separating belt 1610. FIG. 4 is a cross-sectional view illustrating the feeding unit 160*a*. The feeding unit 160*a* loosens and floats the sheet from an end surface in the widthwise direction of a sheet bundle by air, suctions the sheet to the separating belt 1610 by suction air having negative pressure, and separates the sheets into a single sheet by separating air blown from the leading end of the sheet bundle. And the feeding unit 160*a* adopts a full-air feeding type which feeds the sheets one at a time by rotating the separating belt 1610, without using a feeding roller for separating the sheets.

As shown in part (a) of FIG. 3 and FIG. 4, the feeding unit 160*a* is provided with a loosening air unit 170, a separating air unit 180, a first suction unit 1600, the separating belt 1610, a second suction unit 1670 and a driving roller unit 1700.

As shown in part (a) of FIG. 3, the loosening air unit 170 as a first blowing portion includes a side fan 1651 capable of controlling a number of rotation, a side duct 1652, a side nozzle 1653 and a side fan valve 1654. To the side fan 1651, the side duct 1652 having a cylindrical shape is connected, and to a distal end of the side duct 1652, the side nozzle 1653 is provided. These side duct 1652 and side nozzle 1653 are provided at a rear side of the storage 110*a* and at a downstream end portion with respect to the sheet feeding direction D1 of the storage 110*a*.

Air delivered from the side fan 1651 (hereinafter referred to as loosening air) passes through the side duct 1652 and is discharged from the side nozzle 1653. The side duct 1652 is configured to be movable in the widthwise direction W in interrelation with the second side guide 1122 (see FIG. 2). As a result, the side nozzle 1653, from which the loosening air is discharged, is disposed near the leading end portion of the sheet stacked on the storage 110*a* and the rear side of the storage 110*a*.

The side fan valve 1654 is provided between the side fan 1651 and the side duct 1652, and is configured to be openable and closable by a side fan valve solenoid 1655. By controlling opening and closing of the side fan valve 1654, a blowing timing of the loosening air can be controlled.

The separating air unit 180 includes a front fan 1661, a front duct 1662, a front nozzle 1663 and a front fan valve 1664. To the front fan 1661, the front duct 1662 having a cylindrical shape is connected, and to a distal end of the front duct 1662, the front nozzle 1663 is provided. These front duct 1662 and front nozzle 1663 are provided at the downstream end portion with respect to the sheet feeding direction D1 of the storage 110*a*.

Air delivered from the front fan 1661 (hereinafter referred to as "separating air") passes through the front duct 1662 and is discharged from the front nozzle 1663. The front nozzle 1663, from which the separating air is discharged, is disposed toward the separating belt 1610, which is disposed above the sheets stacked in the storage 110*a*.

The front fan valve 1664 is provided between the front fan 1661 and the front duct 1662, and configured to be openable and closable by a front fan valve solenoid 1665. By controlling opening and closing of the front fan valve 1664, a timing of blowing the separating air can be controlled.

The loosening air unit 170 and the separating air unit 180 described above constitute an air blowing portion 800 which blows air to the downstream end portion in the sheet feeding direction D1 of the sheet supported by the lifter plate 1140.

The first suction unit 1600 includes a first suction fan 1601, a first suction chamber 1602 and a first suction fan valve 1603. The first suction chamber 1602 is connected to the first suction fan 1601, and has a space inside. In addition, the first suction chamber 1602 includes an opening 1602*a* in a position opposite to the sheets stacked in the storage 110*a*, and the opening 1602*a* is communicated to the inner space of the first suction chamber 1602. The first suction fan 1601 can generate negative pressure in the inner space of the first suction chamber 1602.

The first suction fan valve 1603 is provided between the first suction fan 1601 and the first suction chamber 1602, and is configured to be openable and closable by a first suction fan valve solenoid 1605. The first suction chamber 1602 becomes negative pressure as the first suction fan valve 1603 is opened in a state in which the first suction fan 1601 is driven.

Around the first suction chamber 1602, as shown in FIG. 4, the separating belt 1610 is disposed, and the separating belt 1610 as a feeding belt is wound around a belt driving roller 1612 and a belt driven roller 1613. And as the belt driving roller 1612 is rotationally driven by the belt driving motor 1614 (see FIG. 6), the separating belt 1610 is rotated, and the belt driven roller 1613 is rotated by the separating belt 1610.

The separating belt 1610 is provided with a plurality of circular holes 1610*a*, as shown in part (b) of FIG. 3, and the plurality of circular holes 1610*a* positioned on a lower surface side of the separating belt 1610 are communicated to the opening 1602*a* of the first suction chamber 1602. Thus, when the inner space of the first suction chamber 1602 becomes negative pressure, the air around the separating belt 1610 can be sucked toward the inside of the first suction chamber 1602 via the opening 1602*a* and the plurality of holes 1610*a* in the separating belt 1610. If there is the sheet near the lower surface of the separating belt 1610, the sheet is suctioned to the separating belt 1610. The plurality of holes 1610*a* include an edge portion 1610*b* of an upstream side in the sheet feeding direction D1 (see part (b) of FIG. 3). The edge portion 1610*b* extends so as to cross the sheet feeding direction D1, which is a moving direction of the separating belt 1610. When the separating belt 1610 is driven in a state in which the sheet is suctioned, the separating belt 1610 conveys the sheet by biting the sheet with the edges 1610*b* of the plurality of holes 1610*a*. By this, it becomes possible for the separating belt 1610 to convey the sheet reliably.

The driving roller unit 1700 is disposed downstream of the separating belt 1610 in the sheet feeding direction D1, as shown in FIG. 4, and is provided with a driving roller 1710 and a driven roller 1720. The driving roller 1710 is driven by a motor, which is not shown, and the driven roller 1720 is rotated by the driving roller 1710. The sheet S sucked and fed by the separating belt 1610 is conveyed by the driving roller unit 1700.

The second suction unit 1670 as an upstream suction portion is disposed upstream of the separating belt 1610 in the sheet feeding direction D1, as shown in part (a) of FIG. 3 and FIG. 4. The second suction unit 1670 includes a second suction fan 1671, a second suction chamber 1672 and a second suction fan valve 1674. The second suction chamber 1672 is connected to the second suction fan 1671, and has a space inside. In addition, the second suction chamber 1672 includes an opening 1672*a* in a position opposite to the sheets stacked in the storage 110*a*, and the opening 1672*a* is communicated to the inner space of the second suction chamber 1672. The second suction fan 1671 as a fan can generate negative pressure in the inner space of the second suction chamber 1672.

The second suction fan valve 1674 is provided between the second suction fan 1671 and the second suction chamber 1672, and is configured to be openable and closable by a second suction fan valve solenoid 1675. The second suction chamber 1672 becomes negative pressure as the second suction fan valve 1674 is opened in a state in which the second suction fan 1671 is driven.

On the second suction chamber 1672, a chamber guide 1676 is mounted so as to cover the opening 1672*a*, and to the chamber guide 1676 as a guide member, a plurality of circular holes 1676*a* are provided. The plurality of holes 1676*a* in the chamber guide 1676 are communicated to the opening 1672*a* of the second suction chamber 1672. Thus, when the inner space of the second suction chamber 1672 becomes negative pressure, the air around the chamber guide 1676 can be sucked toward inside of the second suction chamber 1672 via the opening 1672*a* and the plurality of holes 1676*a* in the chamber guide 1676. If there is the sheet near a lower surface of the chamber guide 1676, the sheet is floated toward the chamber guide 1676.

In addition, between the separating belt 1610 and the chamber guide 1676 in the sheet feeding direction D1, a sheet detection sensor 1620 and a sheet detection flag 1620*a*, and a sheet presence/absence detection sensor 1621 and a sheet presence/absence detection flag 1621*a* are provided.

FIG. 5 is a view illustrating the feeding unit 160*a* as viewed from the upstream side in the sheet feeding direction D1. In FIG. 5, a conveyance center 1622 is a center in the widthwise direction W of the sheet S fed from the storage 110*a* and a center of the conveyance path in the widthwise direction W along which the sheet S is conveyed. In addition, the conveyance center 1622 is a central portion in the widthwise direction W of the first side guide 1121 and the second side guide 1122.

As shown in FIG. 5, the sheet detection sensor 1620 and the sheet detection flag 1620*a* are disposed at one end side in the widthwise direction W with respect to the conveyance center 1622. The sheet presence/absence detection sensor 1621 and the sheet presence/absence detection flag 1621*a* are disposed at the other end side in the widthwise direction W with respect to the conveyance center 1622. The sheet detection flag 1620*a* as a first pressing portion hangs down toward the uppermost sheet of the sheet S stacked on the lifter plate 1140, and contacts a surface of the uppermost sheet during sheet feeding.

The sheet detection sensor 1620 as a first detecting portion detects a height of the uppermost sheet supported by the lifter plate 1140 based on a position of the sheet detection flag 1620*a*. The sheet detection flag 1620*a* rotates from a non-detecting position to a detecting position by contacting the uppermost sheet on the lifter plate 1140. In a state in which the sheet detection flag 1620*a* is positioned in the detecting position, the sheet detection sensor 1620 becomes in a detecting state (ON state). In addition, even when there is no more sheet on the lifter plate 1140, if the lifter plate 1140 is at a predetermined height, the sheet detection flag 1620*a* is held in the detecting position by contacting the lifter plate 1140. Therefore, the detecting state (ON) of the sheet detection sensor 1620 is maintained.

In addition, the sheet presence/absence detection flag 1621*a* as a second pressing portion hangs down toward the uppermost sheet S stacked on the lifter plate 1140, and contacts the surface of the uppermost sheet during the sheet feeding. The sheet presence/absence detection sensor 1621 as a second detecting portion detects the presence/absence of the sheet supported on the lifter plate 1140 based on a position of the sheet presence/absence detection flag 1621*a*. The sheet presence/absence detection flag 1621*a* rotates from a non-detecting position to a detecting position by contacting the uppermost sheet on the lifter plate 1140. In a state in which the sheet presence/absence detection flag 1621*a* is positioned in the detecting position, the sheet presence/absence detection sensor 1621 becomes in a detecting state (ON state). In addition, when there is no more sheet on the lifter plate 1140 and the lifter plate 1140 is at the predetermined height, the sheet presence/absence detection flag 1621*a* rotates from the detecting position to the non-detecting position by falling into an opening formed in the lifter plate 1140. Therefore, the sheet presence/absence detection sensor 1621 becomes in a non-detecting state (OFF).

The sheet detection flag 1620*a* and the sheet presence/absence detection flag 1621*a* are disposed in positions corresponding to vicinity of the trailing end of the sheet of the smallest size, which can be conveyed by the feeding unit 160*a*.

In addition, the sheet detection flag 1620*a* and the sheet presence/absence detection flag 1621*a* are disposed approximately symmetrically in the widthwise direction W with respect to the conveyance center 1622.

The sheet detection flag 1620*a* and the sheet presence/absence detection flag 1621*a* are equipped with weights to prevent the sheet detection flag 1620*a* and the sheet presence/absence detection flag 1621*a* from easily being floated even when the separating air flows between the uppermost sheet and the lower sheet thereof.

In addition, as shown in part (a) of FIG. 3, the separating belt 1610 includes a first suction area AR1, in which the plurality of holes 1610*a* capable of suctioning the sheet are provided, and the chamber guide 1676 also includes a second suction area AR2 in which the plurality of holes 1676*a* capable of sucking the sheet are provided. The first suction area AR1 and the second suction area AR2 are opposing to the uppermost sheet stacking on the lifter plate 1140. In the widthwise direction W, a distance L3 between the sheet detection flag 1620*a* and the sheet presence/absence detection flag 1621*a* is wider than a width L1 of the first suction area AR1 and a width L2 of the second suction area AR2. Therefore, the sheet detection flag 1620*a* and the sheet presence/absence detection flag 1621*a* do not interfere with the suction of the sheet. In addition, in the widthwise direction W, the width L2 of the second suction area AR2 is narrower than the width L1, and is narrower than the distance L3.

[Control Block]

FIG. 6 is a block diagram illustrating control blocks of the feeding module 100. The feeding module 100 includes a media operating portion 1800, to which sheet information 1820, which is information about the sheet to be fed, can be input, and a control portion 1801. Incidentally, the media operating portion 1800 and the control portion 1801 are not limited to disposed at the feeding module 100, but may be disposed at any location within the inkjet recording system 1.

The media operating portion 1800 is constituted by physical buttons, a liquid crystal panel, etc. The sheet information 1820 includes a sheet size 1820*a*, a sheet basis weight 1820*b*, which is weight per unit area of the sheet, a sheet type 1820*c*, which is a type of the sheet such as a plain paper, a coated paper, a synthetic paper and a PET sheet, etc., and the like. The control portion 1801 is provided with a CPU 1802, a ROM 1803, and a RAM 1804. In the ROM 1803, various programs are stored, and the CPU 1802 reads and executes these programs. The RAM 1804 is used as a work area for the CPU 1802.

To the control portion 1801, an environment sensor 1623, the sheet detection sensor 1620 and the sheet presence/absence detection sensor 1621 are connected. The environment sensor 1623 (see part (a) of FIG. 3) can detect ambient humidity 1820*d*, which is humidity in the storage 110*a*, that is, the ambient humidity around the lifter plate 1140. The environment sensor 1623 may detect not only the ambient humidity 1820*d*, but also ambient temperature, etc.

Based on the sheet information 1820 and the ambient humidity 1820*d*, time required to separate the sheets to be fed, easiness of separation, etc. can be estimated. Therefore, the control portion 1801 sets an optimal sheet feeding condition 1004 based on the sheet information 1820 and the ambient humidity 1820*d*. The feeding condition 1004 includes a feeding interval of the sheet, feeding velocity, and a number of rotation of the side fan 1651, the front fan 1661, the first suction fan 1601 and the second suction fan 1671.

For example, in a case in which a sheet having a large basis weight or size, it is preferable to set the number of rotation of each fan high since the weight per sheet is heavy. On the other hand, in a case in which the sheet having a small basis weight or size, if the number of rotation of each fan is set high, the sheet will flutter, causing conveyance defect and oblique movement. Therefore, for the sheets having the small basis weight or size, it is preferable set the number of rotation low. In addition, for a type of the sheet which tends to adhere to each other, especially in an environment with high humidity, it is possible to separate and feed the sheet stably by setting the number of rotation of each fan high or the feeding interval widened.

The control portion 1801 controls the side fan 1651, the side fan valve solenoid 1655, the front fan 1661, the front fan valve solenoid 1665, the first suction fan 1601, the first suction fan valve solenoid 1605, the second suction fan 1671, the second suction fan valve solenoid 1675 and the belt driving motor 1614 based on the set feeding conditions 1004.

[Feeding Operation]

Next, feeding operation by the feeding module 100 will be described. FIG. 7 is a flowchart illustrating the feeding operation. After setting the feeding conditions 1004, the control portion 1801 starts the feeding operation.

First, the control portion 1801, as a feeding preparation operation, rotates the side fan 1651, the front fan 1661, the first suction fan 1601 and the second suction fan 1671 at a number of rotation based on the feeding conditions 1004. At this time, the side fan valve solenoid 1655, the front fan valve solenoid 1665, the first suction fan valve solenoid 1605 and the second suction fan valve solenoid 1675 are closed.

When each fan reaches a predetermined number of rotation, a feeding start signal is sent from the control portion 1801 and the feeding operation is initiated. As shown in FIG. 7, the control portion 1801 opens the side fan valve 1654 by turning on the side fan valve solenoid 1655 (step S1). Then, the loosening air generated by the side fan 1651 is blown from the side nozzles 1653 to a plurality of sheets, including the uppermost sheet, in the sheet bundle stacked on the lifter plate 1140. The loosening air is blown to the leading end portion and side end portions of the sheet in the widthwise direction W from one end side in the widthwise direction W. By this loosening air, the side end portions of the leading end portion of the uppermost sheet in the sheet bundle is floated.

Next, the control portion 1801 opens the first suction fan valve 1603 by turning on the first suction fan valve solenoid 1605 (step S2). By this, the inner space of the first suction chamber 1602 is made to be negative pressure. Air is then sucked from the plurality of holes 1610*a* in the separating belt 1610 disposed around the first suction chamber 1602, and the uppermost sheet, which is floated by the loosening air, is sucked onto the separating belt 1610.

In addition, at substantially the same timing as step S2, the control portion 1801 opens the front fan valve 1664 by turning on the front fan valve solenoid 1665 (step S3). By this, the separating air generated by the front fan 1661 is blown from the front nozzle 1663 to the plurality of sheets, including the uppermost sheet, in the sheet bundle stacked on the lifter plate 1140. The separating air is blown to the leading end portion of the sheet from the downstream to the upstream in the sheet feeding direction D1.

Then, in a state in which the uppermost sheet is suctioned to the separating belt 1610, the separating air blows between the uppermost sheet and the lower sheet of (directly below) the uppermost sheet (hereinafter referred to as a "lower sheet") to separate the uppermost sheet and the lower sheet from each other. Here, in order to securely separate the uppermost sheet from the lower sheet and feed only the uppermost sheet, the separating air must be flown from the leading end to the trailing end of the uppermost sheet.

While the leading end portion of the uppermost sheet is sucked by the separating belt 1610, the lower sheet falls by gravity when floating force by the loosening air is gone. Then, a gap opens between the uppermost sheet and the lower sheet, and if the separating air is blown into the gap, then it becomes easier for the separating air to flow from the leading end to the trailing end of the uppermost sheet. The width of the front nozzle 1663 in the widthwise direction W is approximately the same as the width L1 of the first suction area AR1. By this, it becomes possible for the separating air to flow efficiently toward a lower surface of the uppermost sheet sucked to the first suction area AR1.

While the first suction area AR1 is disposed in the approximately center of the sheet conveyance area in the widthwise direction W, the sheet detection flag 1620*a* and the sheet presence/absence detection flag 1621*a* are disposed outside of the first suction area AR1 in the widthwise direction. The sheet detection flag 1620A and the sheet presence/absence detection flag 1621A then hold the uppermost sheet from above. Therefore, the separating air flowing directly under the first suction area AR1 passes through space formed by the sheet detection flag 1620*a* and the sheet presence/absence detection flag 1621*a* in a tunnel-shaped between the uppermost sheet and the lower sheet. The space for the separating air to pass through is restricted in the widthwise direction W by the sheet detection flag 1620*a* and the sheet presence/absence detection flag 1621*a*, which allows the separating air to more easily reach the upstream side in the sheet feeding direction D1.

In addition, in the present Embodiment, as described above, the relationship between the width L1 of the first suction area AR1, the width L2 of the second suction area AR2, and the distance L3 is L3>L1≥L2. Therefore, an air path between the uppermost sheet and the lower sheet, through which the separating air passes, tends to taper from the downstream to the upstream in the sheet feeding direction D1. And even in an area further upstream of the second suction area AR2, the separating air does not spread out, making it easier for the separating air to reach the trailing end of the uppermost sheet. Furthermore, the system is configured so that the uppermost sheet is not prevented from being suctioned by the sheet detection flag 1620*a* and the sheet presence/absence detection flag 1621*a*. The relationship between the width L1 of the first suction area AR1, the width L2 of the second suction area AR2, and the distance L3 is not limited to L3>L1≥L2, but the effect of suction of the sheet by the second suction area AR2 can be achieved even when the relationship is set in whatever way.

Furthermore, the control portion 1801 opens the second suction fan valve 1674 by turning on the second suction fan valve solenoid 1675 based on the conditions described below (step S4). By this, the inner space of the second suction chamber 1672 is made to be negative pressure. Air is then sucked from the plurality of holes 1676*a* in the chamber guide 1676, and the floating of the uppermost sheet is assisted at positions corresponding to the plurality of holes 1676*a*. By this, it becomes possible to improve separating performance of the uppermost sheet and the lower sheet since the separating air flows from the leading end to the trailing end of the uppermost sheet, i.e., from the downstream end to the upstream end in the sheet feeding direction D1. The main object of the negative pressure in the second suction chamber 1672 is to assist the floating of the uppermost sheet, and the uppermost sheet does not necessarily have to be sucked to the chamber guide 1676. Incidentally, step S4 may be omitted depending on conditions described below. For example, in a case of feeding the sheet having a short length or low adhesion, the second suction fan valve 1674 may be left closed, or the second suction fan 1671 may be left stopped.

The control portion 1801 then closes the side fan valve 1654 by turning off the side fan valve solenoid 1655 (step S5). In addition, the control portion 1801 also closes the second suction fan valve 1674 by turning off the second suction fan valve solenoid 1675 (step S6). This is because once the separating air flows from the leading end to the trailing end of the uppermost sheet, there is no need for floating of the sheet by the loosening air and the negative pressure of the second suction chamber 1672. By stopping the loosening air and releasing the negative pressure in the second suction chamber 1672, it becomes possible to reduce the conveyance resistance upon feeding the uppermost sheet and to suppress the conveyance defect such as the oblique movement. Incidentally, a surface of the chamber guide 1676 is made of material having low frictional resistance, so that the conveyance resistance between the chamber guide 1676 and the uppermost sheet is low.

Next, the control portion 1801 rotates the separating belt 1610 by driving the belt driving roller 1612 (step S7). At this time, since the leading end of the uppermost sheet sucked by the separating belt 1610 is positioned above the leading end guide 1131, the leading end guide 1131 does not interfere with the feeding of the uppermost sheet. Next, the control portion 1801 determines whether or not the uppermost sheet has reached the driving roller 1710 of the driving roller unit 1700 (step S8). If it is determined that the uppermost sheet has reached the driving roller 1710 (Yes in step S8), the control portion 1801 then turns off the front fan valve solenoid 1665 and the first suction fan valve solenoid 1605 (steps S9 and S10). By this, the front fan valve 1664 and the first suction fan valve 1604 are closed, the separating air is stopped, and the suction of the uppermost sheet to the separating belt 1610 is released.

The separating belt 1610 continues to rotate after the first suction fan valve 1604 is closed, and when the trailing end of the uppermost sheet exits the storage 110*a*, the control portion 1801 stops the belt driving roller 1612 (step S11). After the first suction fan valve 1604 is closed, even if the uppermost sheet is sucked to the separating belt 1610 by residual pressure in the first suction chamber 1602, since the separating belt 1610 continues to rotate, the conveyance resistance can be suppressed. Thereafter, the operation of steps S1 through S11 is repeated until the feeding of a number of sheets specified in a job is completed or the sheets in the storage 110*a* run out.

[Setting the Suction Force of the Second Suction Unit]

Next, a flow of setting the suction force of the second suction unit 1670 will be described using a flowchart shown in FIG. 8. The control portion 1801 is capable of changing the suction force and a suction timing of the second suction unit 1670 based on the sheet information 1820, which is input from the media operating portion 1800 or an external computer, and the ambient humidity 1820*d* detected by the environment sensor 1623. Incidentally, hereinafter, control for changing the suction force and the suction timing of the second suction unit 1670 will be described, however, only one of the suction force and the suction timing may be changed.

As an example of the control for changing the suction force and the suction timing of the second suction unit 1670, it is described in accordance with the flowchart in FIG. 8. As shown in FIG. 8, the control portion 1801 determines whether or not the sheet size 1820*a* is A3 size or larger (step S21). If it is determined that the sheet size 1820*a* is smaller than A3 size (No in step S21), then the control portion 1801 proceeds the process to steps S31 through S33.

If it is determined that the sheet size 1820*a* is A3 size or larger (Yes in step S21), then the control portion 1801 determines whether or not the ambient humidity 1820*d* is 60% or higher (step S22). If it is determined that the ambient humidity 1820*d* is less than 60% (No in step S22), then the control portion 1801 proceeds the process to steps S31 through S33.

If it is determined that the ambient humidity 1820*d* is 60% or more (Yes in step S22), then the control portion 1801 determines whether or not the sheet basis weight 1820*b* is 200 g/m$^2$ or more (step S23). If it is determined that the sheet basis weight 1820*b* is 200 g/m$^2$ or more (Yes in step S23), then the control portion 1801 determines whether or not the sheet type 1820*c* is a coated sheet (step S24). If it is determined that the sheet type 1820*c* is the coated sheet (Yes in step S24), then the control portion 1801 proceeds the process to steps S41 through S43. If it is determined that the sheet type 1820*c* is not the coated sheet (No in step S24), then the control portion 1801 proceeds the process to steps S51 through S53.

In addition, in step S23, if it is determined that the sheet basis weight 1820*b* is less than 200 g/m$^2$ (No in step S23), then the control portion 1801 proceeds the process to steps S61 through S63. In the present Embodiment, the suction force and the suction timing of the second suction unit 1670 are controlled in four separate patterns.

The steps S31 through S33 are a case in which the suction of the uppermost sheet by the second suction unit 1670 is not required. In this case, the control portion 1801 sets the suction force of the second suction unit 1670 to 0, i.e., the number of rotation of the second suction fan 1671 to 0 rpm (steps S31 and S32). And the control portion 1801 does not perform turning on/off of the second suction fan valve solenoid 1675 (step S33). Thus, if the sheet size 1820*a* is less than A3 size or the ambient humidity 1820*d* is less than 60%, then the second suction unit 1670 is not used. This is because the second suction unit 1670 is not required to float the trailing end portion of the uppermost sheet when the sheet is short, and the adhesion between the sheets is low when the ambient humidity 1820*d* is less than 60%.

The steps S41 through S44 are a case in which the suction of the uppermost sheet by the second suction unit 1670 is mostly required. In this case, the control portion 1801 sets the suction force of the second suction unit 1670 to large (step S41). Specifically, the control portion 1801 sets the number of rotation of the second suction fan 1671 to 10000 rpm (step S42). The control portion 1801 then sets an ON timing of the second suction fan valve solenoid 1675 earlier than normal and sets an OFF timing later than normal (step S43). By this, it becomes possible to increase the suction force of the second suction unit 1670 and also lengthen the suction time.

The steps S51 through 54 are a case in which the suction of the uppermost sheet by the second suction unit 1670 is required next to the steps S41 through S43. In this case, the control portion 1801 sets the suction force of the second suction unit 1670 to medium (step S51). Specifically, the control portion 1801 sets the number of rotation of the second suction fan 1671 to 6000 rpm (step S52). The control portion 1801 then sets the ON timing and the OFF timing of the second suction fan valve solenoid 1675 to normal (step S53).

The steps S61 through S64 are a case in which the suction of the uppermost sheet by the second suction unit 1670 is required next to the steps S51 through S53. In this case, the control portion 1801 sets the suction force of the second suction unit 1670 to small (step S61). Specifically, the control portion 1801 sets the number of rotation of the second suction fan 1671 to 3000 rpm (step S62). The control portion 1801 then sets the ON timing of the second suction fan valve solenoid 1675 later than normal and sets the OFF timing earlier than normal (step S63).

Thus, the larger the sheet size 1820*a* (especially a length of the sheet), the higher the ambient humidity 1820*d* and the larger the sheet basis weight 1820*b*, and the sheet type is the coated sheet, the more the suction of the uppermost sheet by the second suction unit 1670 is required.

As described above, in the present Embodiment, the second suction unit 1670 is provided upstream of the separating belt 1610 in the sheet feeding direction D1. By this, it becomes possible for the second suction unit 1670 to assist the floating of the trailing end side of the sheet, especially of a long sheet such as B3 size or a sheet having a large basis weight, and for the separating air to exit from the leading end to the trailing end of the uppermost sheet. Therefore, regardless of the sheet size, the basis weight, the type, the ambient humidity, etc., it is possible to convey the sheet while stably separating the sheets, thus to suppress the separation defect of the sheets.

In addition, since it is possible to change the suction force of the second suction unit 1670 based on the sheet information 1820 and the ambient humidity 1820*d*, variation in a floating amount of the uppermost sheet, which is sucked and floated by the second suction unit 1670, can be suppressed. Therefore, regardless of the size, the basis weight, the type, the ambient humidity, etc. of the sheets to be fed, the system can convey the sheets while separating the sheets more stably. More specifically, for the long and heavy sheet, and for the sheet type and the surrounding environment where adhesion between the sheets is high, the uppermost sheet can be more reliably separated from the lower sheet by increasing the suction force of the second suction unit 1670. In addition, for the short and light sheet, and for the sheet type and the surrounding environment where adhesion between the sheets is low, it becomes possible to suppress the conveyance defect such as the oblique movement by reducing the conveyance resistance of the sheet by reducing the suction force of the second suction unit 1670 (including a case of no suction).

Embodiment 2

Next, an Embodiment 2 of the present invention will be described, and the Embodiment 2 is what makes the plurality of holes provided in the chamber guide 1676 of the Embodiment 1 be configured to be in forms of elongated holes. Therefore, with respect to the same configurations as in the Embodiment 1, illustrations in Figures will be omitted, or the same reference numerals will be attached in Figures.

Part (a) of FIG. 9 is a bottom view of a feeding unit 260*a* according to the Embodiment 2, and part (b) of FIG. 9 is an enlarged view illustrating a plurality of elongated holes 2676*a* provided in a chamber guide 2676. As shown in part (a) of FIG. 9, the feeding unit 260*a* according to the present Embodiment includes the separating belt 1610, the first suction unit 1600, and a second suction unit 2670. Incidentally, although not shown in part (a) of FIG. 9, the feeding unit 260*a* includes the loosening air unit 170, the separating air unit 180, and the driving roller unit 1700, as in the Embodiment 1.

The second suction unit 2670 as the upstream suction portion is provided with the second suction fan 1671 (see part (a) of FIG. 3), a second suction chamber 2672 and the second suction fan valve 1674 (see part (a) of FIG. 3). The second suction chamber 2672 is connected to the second suction fan 1671, and has a space inside.

On the second suction chamber 2672, the chamber guide 2676 is mounted so as to cover an opening 2672*a* of the second suction chamber 2672, and to the chamber guide 2676 as a guide member, the plurality of elongated holes 2676*a* are provided. Each elongated hole 2676*a* is long in the sheet feeding direction D1 relative to the widthwise direction W. The plurality of elongated holes 2676*a* in the chamber guide 2676 are communicated to the opening 2672*a* of the second suction chamber 2672. Thus, when the inner space of the second suction chamber 2672 becomes negative pressure, the air around the chamber guide 2676 can be sucked toward inside of the second suction chamber 2672 via the opening 2672*a* and the plurality of elongated holes 2676*a* in the chamber guide 2676. If there is the sheet near a lower surface of the chamber guide 2676, the sheet is floated toward the chamber guide 2676. Incidentally, also in the present Embodiment, the relationship between the width L1 of the first suction area AR1, the width L2 of the second suction area AR2 and the distance L3 satisfies L3>L1≥L2.

The feeding preparation operation and the feeding operation by the feeding unit 260*a* in the present Embodiment is the same as in the Embodiment 1 described in FIG. 7. Here, immediately after closing the second suction fan valve 1674 in step S6 of FIG. 7, negative pressure remains in the second suction chamber 2672, and there is a case in which the sheet is conveyed in a state of being still sucked by the chamber guide 2676. As described above, the separating belt 1610 generates the conveyance force of the sheet by biting the sheet with the edge portions 1610*b* (see part (b) of FIG. 3) of the plurality of circular holes 1610*a*. However, if the sheet is conveyed with being still suctioned by the chamber guide 2676, as shown in part (a) and part (b) of FIG. 9, the conveyance resistance of the sheet is increased as the sheet slides on edge portions 2676*b* of the elongated hole 2676*a* provided in the chamber guide 2676. The edge portion 2676*b* is an edge of a downstream end portion of the elongated hole 2676*a* in the sheet feeding direction D1, and extends so as to cross the sheet feeding direction D1.

In the present Embodiment, since the chamber guide 2676 is provided with elongated holes extending in the sheet feeding direction D1, the conveyance resistance can be reduced compared to the Embodiment 1 in which the plurality of circular holes 1676*a* are provided. This is because the edge portions 2676*b* of the plurality of elongated holes 2676*a* are fewer than the edge portions of the circular holes 1676*a* of the Embodiment 1.

Furthermore, since positions of the edge portions 2676*b* of the plurality of elongated holes 2676*a* in the sheet feeding direction D1 are the same as each other, the conveyance resistance acting on the sheet due to the edge portions 2676*b* is likely to be uniform in the widthwise direction W. Therefore, it becomes possible to reduce the conveyance defect such as the oblique movement of the sheet. Incidentally, a surface of the chamber guide 2676 is made of material having low frictional resistance, so that the conveyance resistance between the chamber guide 2676 and the uppermost sheet is low.

Embodiment 3

Next, an Embodiment 3 of the present invention will be described, and the Embodiment 3 is what a plurality of driven rollers 1680 are provided in the chamber guide 2676 of the Embodiment 2. Therefore, with respect to the same configurations as in the Embodiment 2, illustrations in Figures will be omitted, or the same reference numerals will be attached in Figures.

FIG. 10 is a perspective view illustrating a second suction unit 3670 as the upstream suction portion according to the Embodiment 3. The second suction unit 3670 includes the plurality of driven rollers 1680 as rotatable members which are rotated by contacting the sheet fed in the sheet feeding direction D1, as shown in FIG. 10. These plurality of driven rollers 1680 are provided in the second suction area AR2 and are disposed so that a part of outer shape thereof is protruded from the plurality of elongated holes 2676*a* in the chamber guide 2676.

Therefore, when the sheet is sucked to the chamber guide 2676, the sheet is pressed against the driven rollers 1680. And even if there is residual pressure in the second suction chamber 2672, when the sheet is conveyed in the sheet feeding direction D1, the driven roller 1680 are rotated relative to the sheet to be conveyed, therefore the conveyance resistance is reduced.

Embodiment 4

Next, an Embodiment 4 of the present invention will be described, and the Embodiment 4 is what a plurality of ribs 1690 are provided in the chamber guide 2676 of the Embodiment 2. Therefore, with respect to the same configurations as in the Embodiment 2, illustrations in Figures will be omitted, or the same reference numerals will be attached in Figures.

FIG. 11 is a perspective view illustrating a second suction unit 4670 as the upstream suction portion according to the Embodiment 4. The second suction unit 4670 includes a plurality of ribs 1690 which extends in the sheet feeding direction D1 and can slide against the sheet to be conveyed, as shown in FIG. 11. The ribs 1690 have a shorter width in the widthwise direction W relative to lengths in the sheet feeding direction D1. These plurality of ribs 1690 are provided in the second suction area AR2 and alternately with the plurality of elongated holes 2676*a* of the chamber guide 3676 as a guide member in the widthwise direction W.

Therefore, when the sheet is sucked to the chamber guide 3676, the sheet is pressed against tips of the plurality of ribs 1690. And even if there is residual pressure in the second suction chamber 3672, since the sheet conveyed in the sheet conveyance direction D1 slides on the plurality of ribs 1690, the conveyance resistance is reduced.

OTHER EMBODIMENTS

Incidentally, in all of the Embodiments described above, the second suction unit 1670, 2670, 3670 and 4670 provided with one second suction chamber 1672, 2672 is disposed as an assisting means for flowing the separating air to the trailing end of the sheet, however, it is not limited thereto. For example, if, in addition to the second suction unit 1670, 2670, 3670 and 4670, more suction units are added so as to assist the floating of the sheet with a plurality of suction units, it becomes possible to handle the sheet of even larger sizes. In addition, the second suction unit 1670, 2670, 3670 and 4670 may be configured to be movable in the sheet feeding direction D1, and depending on attributes of the sheets to be fed and the humidity environment, the second suction unit 1670, 2670, 3670 and 4670 may be moved in the sheet feeding direction D1.

In addition, in all of the Embodiments described above, the loosening air unit 170 and the separating air unit 180 are constituted separately, and the uppermost sheet and the lower sheet are separated by the loosening air and the separating air, however, it is not limited thereto. For example, the loosening air unit 170 may be omitted and the uppermost sheet may be separated from the lower sheet by the separating air unit 180 and separating belt 1610.

In addition, in all of the Embodiments described above, the side fan valve 1654 and the second suction fan valve 1674 are closed (steps S5 and S6) before driving the separating belt 1610, however, it is not limited thereto. For example, instead of closing the side fan valve 1654 and the second suction fan valve 1674, the number of rotation of the side fan 1651 and the second suction fan 1671 may be reduced, or the side fan 1651 and the second suction fan 1671 may be stopped. In addition, upon driving the separating belt 1610, the side fan valve 1654 and the second suction fan valve 1674 may be left open.

In addition, in all of the Embodiments described above, the air path through which the separating air passes is formed by the sheet detection flag 1620*a* and the sheet presence/absence detection flag 1621*a*, however, it is not limited thereto. For example, apart from each sensor flag, a pressing portion which presses the uppermost sheet from above may be provided.

In addition, in all of the Embodiments described above, the suction force and the suction timing of the second suction unit 1670, 2670, 3670 and 4670 are controlled in the four different patterns based on the sheet information 1820 and the ambient humidity 1820*d*, however, it is not limited thereto. For example, regardless of the sheet information 1820 and the ambient humidity 1820*d*, the suction force and the suction timing of the second suction units 1670, 2670, 3670 and 4670 may be set to constant. In addition, the suction force and the suction timing of the second suction units 1670, 2670, 3670 and 4670 may be controlled in two or three patterns, or five or more patterns.

In addition, in all of the Embodiments described above, the suction force of the second suction units 1670, 2670, 3670 and 4670 is changed based on the size (length in the sheet feeding direction D1), the basis weight and the type of the sheet supported on the lifter plate 1140 and the ambient humidity, however, it is not limited thereto. For example, the suction force of the second suction units 1670, 2670, 3670 and 4670 may be changed by any one of the sheet size (length in the sheet feeding direction D1), the basis weight, the type and the ambient humidity, or combining arbitrary conditions. In other words, the suction force of the second suction unit 1670, 2670, 3670 and 4670 may be changed based on at least one of the sheet size (length in the sheet feeding direction D1), the basis weight, the type and the ambient humidity.

In addition, in all of the Embodiments described above, the feeding module 100 and the printing module 200 are separately constituted, however, the present invention may be applied to an image forming apparatus in which the feeding module 100 and the printing module 200 are integrally formed. Incidentally, the image forming apparatus includes a printer, a copy machine, a facsimile machine and a multifunction machine, and shall refer to any apparatus, which forms an image on a sheet used as a recording media, based on image information input from an external PC or image information read from a document. Further, there is a case that, to the image forming apparatus, in addition to a main assembly having an image forming function, an accessory apparatus such as an optional feeder, an image reading apparatus, a sheet processing apparatus, etc. is connected, and an entire system in which such accessory apparatuses are connected is also one type of the image forming apparatus.

In addition, in all of the Embodiments described above, the feeding module 100 is described as an example of the sheet feeding device, however, it is not limited thereto. For example, the feeding module 100 and the printing module 200 may be considered as the sheet feeding device, or an entire ink jet recording apparatus 1 may be considered as the sheet feeding device. In addition, any combination of any modules within the ink jet recording apparatus 1, including the feeding module 100, may be considered as the sheet feeding device. In this case, the control portion 1801, which controls the suction force of the second suction unit 1670, 2670, 3670 and 4670 of the sheet feeding device, may be disposed anywhere in the sheet feeding device. For example, when the entire ink jet recording apparatus 1 is considered as the sheet feeding device, the suction force of the second suction unit 1670, 2670, 3670 and 4670 may be controlled by the control portion 1801 disposed in the printing module 200.

The present Embodiment may also be realized by a process in which a program realizing one or more functions of the Embodiments described above is supplied to the system or the device via a network or the storage medium, and a one or more processors in a computer of the system or the device read out and execute the program. In addition, the present invention can also be realized by a circuit which realizes one or more functions (e.g., ASIC).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications Nos. 2023-086522 filed on May 25, 2023 and 2023-131593 filed on Aug. 10, 2023, which are hereby incorporated by reference herein in their entirety.

What is claimed is:

1. A sheet feeding device comprising:

a sheet supporting portion configured to support sheets;

an air blowing portion configured to blow an air toward an upstream end from a downstream end of the sheets supported by the sheet supporting portion in a sheet feeding direction;

a feeding belt configured to feed and suck the uppermost sheet of the sheets to which the air is blown by the air blowing portion; and an upstream suction portion disposed upstream of the feeding belt in the sheet feeding direction and configured to suck the uppermost sheet, wherein the feeding belt includes a first suction area opposing the uppermost sheet and configured to suck the uppermost sheet, and the upstream suction portion includes a second suction area opposing the uppermost sheet and configured to suck the uppermost sheet, and wherein in a widthwise direction perpendicular to the sheet feeding direction, a width of the second suction area is narrower than a width of the first suction area.

2. A sheet feeding device according to claim 1, wherein the feeding belt includes a plurality of holes configured to suck the uppermost sheet by negative pressure, and the upstream suction portion is provided with a guide member including a plurality of holes configured to suck the uppermost sheet by negative pressure, and wherein the first suction area is an area where the plurality of holes of the feeding belt are provided, and the second suction area is an area where the plurality of holes of the guide member are provided.

3. A sheet feeding device according to claim 2, wherein each of the plurality of holes provided in the second suction area is an elongated hole which is long in the sheet feeding direction with respect to the widthwise direction.

4. A sheet feeding device according to claim 2, wherein the upstream suction portion includes a rotatable member provided in the second suction area and configured to be rotated by contacting the sheet fed in the sheet feeding direction.

5. A sheet feeding device according to claim 2, wherein the guide member includes a rib provided in the second suction area, and wherein the rib extends in the sheet feeding direction and slides on the sheet fed in the sheet feeding direction.

6. A sheet feeding device according to claim 2, further comprising a first pressing portion disposed at one end side with respect to a center of the sheet supported by the sheet supporting portion in the widthwise direction and configured to press the uppermost sheet from above, and a second pressing portion disposed at the other end side with respect to the center of the sheet in the widthwise direction and configured to press the uppermost sheet from above.

7. A sheet feeding device according to claim 6, wherein the first pressing portion and the second pressing portion are disposed between the feeding belt and the guide member in the sheet feeding direction.

8. A sheet feeding device according to claim 6, wherein the feeding belt and the guide member is disposed between the first pressing portion and the second pressing portion in the widthwise direction.

9. A sheet feeding device according to claim 1, further comprising a first pressing portion disposed at one end side with respect to a center of the sheet supported by the sheet supporting portion in the widthwise direction and configured to press the uppermost sheet from above, and a second pressing portion disposed at the other end side with respect to the center of the sheet in the widthwise direction and configured to press the uppermost sheet from above.

10. A sheet feeding device according to claim 9, further comprising a first detecting portion configured to detect a height of the uppermost sheet supported by the sheet supporting portion based on a position of the first pressing portion, and a second detecting portion configured to detect presence/absence of the sheets supported by the sheet supporting portion based on a position of the second pressing portion.

11. A sheet feeding device according to claim 9, wherein in the widthwise direction, the width of the second suction area is narrower than a distance between the first pressing portion and the second pressing portion.

12. A sheet feeding device according to claim 1, wherein the upstream suction portion includes a fan, and further comprising a control portion capable of changing a suction force of the upstream suction portion by changing a number of rotation of the fan.

13. A sheet feeding device according to claim 12, wherein the control portion is capable of changing a suction timing of the uppermost sheet by the upstream suction portion.

14. A sheet feeding device according to claim 12, wherein the control portion changes the suction force of the upstream suction portion based on a length with respect to the widthwise direction, a basis weight and a sort of the sheet supported by the sheet supporting portion and information on an ambient humidity of the sheet supporting portion.

* * * * *